United States Patent [19]

Ellenberger

[11] Patent Number: 5,035,054

[45] Date of Patent: Jul. 30, 1991

[54] CUTTING BLADE MOUNTED APPARATUS FOR CONTROLLED PRECISION CUT OF SHEET MATERIAL

[76] Inventor: Jane A. Ellenberger, 63 Gunckel Ave., Dayton, Ohio 45410

[21] Appl. No.: 588,606

[22] Filed: Sep. 26, 1990

[51] Int. Cl.[5] ..... B26B 13/00; B26B 11/00; A44B 1/04; A41F 1/00

[52] U.S. Cl. ..... 30/233; 7/163; 24/304; 24/545

[58] Field of Search ..... 30/233, 286, 278; 7/150, 163, 164; 24/304, 455, 456, 457, 458, 545, 546

[56] References Cited

U.S. PATENT DOCUMENTS

| | | | |
|---|---|---|---|
| Des. 142,249 | 8/1945 | Vining | 24/455 |
| 178,093 | 5/1876 | Wiggins | 30/233 |
| 464,750 | 12/1891 | Campbell | 30/233 |
| 1,928,536 | 9/1933 | Heinlen et al. | 24/545 |
| 3,309,052 | 3/1967 | Borisof | 24/304 |

*Primary Examiner*—Douglas D. Watts
*Assistant Examiner*—Paul M. Heyrana, Sr.
*Attorney, Agent, or Firm*—Jerome P. Bloom

[57] ABSTRACT

Apparatus mounting to the flat of the top blade of a scissors or like cutting device, intermediate its ends, and forming an assembly thereof in use, comprises a holder having a generally oblong substantially block-like configuration one surface portion of which provides its bottom and correspondingly its base as it seats to the aforementioned flat and projects therefrom in a perpendicularly projected relation thereto. This base is provided with means causing it to adhere to said flat. A second surface portion of this holder is distinguished by an inwardly directed slit which accommodates and defines a grip portion of the holder which receives, accommodates and retains a portion of a slide gage rule or its equivalent to establish the rule in a perpendicularly projected relation to that flat to which the holder seats. In another form and arrangement of this apparatus an exterior surface portion of the holder which is at one end of the length of said block-like configuration defines its bottom as it seats to the flat. As will be seen, such apparatus, as so constructed, lends the user of the scissors to which it mounts an ability to evenly trim and cut strips and segments from clothing or sheet-like materials so effectively as to obviate need for tedious premeasuring or premarking procedures while insuring quality results in a minimum period of time.

14 Claims, 1 Drawing Sheet

CUTTING BLADE MOUNTED APPARATUS FOR CONTROLLED PRECISION CUT OF SHEET MATERIAL

BACKGROUND OF THE INVENTION

This invention was conceived and developed on recognition of a serious need which has heretofore plagued those persons and companies engaged in the many businesses or hobbies wherein they have been required or have desired in one respect or another to adjust, alter or create garments or other articles of fabric or modify or convert sheet materials from one form to another and in the process thereof cut and/or trim therefrom various segments thereof having different sizes and shapes. Such operations have heretofore entailed a considerable amount of tedious detailed preliminary mark up before the actual trimming and cutting could take place.

Embodiments of the present invention answer such need since in the use thereof in application to purposes such as noted the requirement for tedious preliminary marking is substantially or virtually eliminated. Moreover, the end products resulting are found to be most satisfactory and to have a distinctly improved quality. At the same time there is a significant savings in the time and cost of their production.

Correspondingly and more particularly it has been found that embodiments of the present invention are highly advantangeous for use by tailors, seamstresses and clothing designers as well as designers of sheet-like products widely used in the home and other facilities. Accordingly the invention, as exemplified herein, will particularly illustrated in this context.

As contrasted to prior art apparatus and procedures heretofore suggested for similar purposes, embodiments of the present invention are basically much easier, more efficient and satisfactory as well as more economical in use due to their nature and the versatile modes of their application which they make possible.

A most significant advance in the art is exhibited by the fact that people using the illustrated preferred embodiments of the invention are enabled thereby to effect essentially precision trimming and cutting of the material being worked along lines that may be either linear, non linear or circular in configuration.

SUMMARY OF THE INVENTION

One embodiment of the present invention especially advantageous for use by mechanics, tailors, seamstresses, as well as designers and creators of garments and other articles, who must variously pattern, cut, trim, adjust and alter that on which they work, as circumstances may require, comprises a holder designed to mount to a cutting blade which may be selectively applied to adjust and/or alter or to variously otherwise cut, trim and segment the articles and materials to which they apply. Basically this preferred embodiment comprises a multi-surfaced element including a base surface portion modified to per se provide means for the stable mount thereof to a cutting blade to establish it in an outwardly projected relation thereto. The holder is further distinguished by a slit directed inwardly of another surface portion of said element, said slit defining in said element, as an integral part thereof, a grip means accommodating the slip or snap fit insertion therein of a slide gage rule to mount this rule so as to project outwardly from and perpendicular to said element and the blade to which it seats.

A more preferred form of this embodiment applicable to a flat on the top cutting blade of a scissors comprises is a multi-surfaced element for mounting a slide gage rule or its equivalent in an outwardly directed laterally projected relation to the cutting blade to which it applies features a slit directed inwardly of the body thereof, said body having a bore therein which is intersected by the innermost limit of the slit and the slit is oriented to be perpendicular to one surface portion of its body which defines its base. A modification of this form of embodiment provides its base surface with the property of effecting an adherent mount thereof to that surface of the cutting blade to which it applies.

From another perspective, a more preferred embodiment of the invention is a holder for a slide gage rule having a substantially block shaped form one surface of which defines its bottom which is adapted to seat to a flat portion of the top blade of a scissors. Another surface portion of this substantially block-shaped form is modified to include therein a slit which opens outwardly therefrom. Said slit is located in a plane which is oriented in a direction perpendicular to said base and bounded by means shaped to accommodate the insertion in said slit of a portion of the base end of a slide gage rule to inherently establish a rule so applied in an outwardly projected relation to said holder and essentially perpendicular the blade surface to which it seats.

Apparatus mounting to the flat of the top blade of a scissors or like cutting device, intermediate its ends, and forming an assembly thereof in use, comprises a holder having a generally oblong substantially block-like configuration one surface portion of which provides its bottom and correspondingly its base as it seats to the aforementioned flat and projects therefrom in a perpendicularly projected relation thereto. This base is provided with means causing it to adhere to said flat. A second surface portion of this holder is distinguished by an inwardly directed slit which accommodates and defines a grip portion of the holder which receives, accommodates and retains a portion of a slide gage rule or its equivalent to establish the rule in a perpendicularly projected relation to that flat to which the holder seats. In another form and arrangement of this apparatus an exterior surface portion of the holder which is at one end of the length of said block-like configuration defines its bottom as it seats to the flat. As will be seen, such apparatus, as so constructed, lends the user of the scissors to which it mounts an ability to evenly trim and cut strips and segments from clothing or sheet-like materials so effectively as to obviate need for tedious premeasuring or premarking procedures while insuring quality results in a minimum period of time.

According to another perspective of the invention, a further embodiment thereof comprises a device including an oblong block-like element having a slit directed inwardly of one surface thereof in intersecting relation to a bore directed inwardly of said block from another surface thereof which is in an adjacednt spaced relation to a third surface thereof defining the base of said block, said slit being bounded by means formed to inherently accommodate and grip a portion of a slide gage rule which is applied therein to establish such rule in an essentially perpendicular relation to said base. A further embodiment of this invention features the just described block-like element as part of an assembly wherein said base thereof is secured to a flat provided on the exterior surface of the top blade of the scissors, intermediate the length thereof having a slide gage rule lodged in said slit in said block to project outwardly therefrom and in an orientation perpendicular to the base of said block, thereby to provide that said block and the blade secured thereto projects outwardly from and laterally out said blade in the application thereof to its intended use. In a particularly preferred modification of this embodiment the said block has the length thereof oriented lengthwise of said blade at a location or closely adjacent its projected limit than the other limit of said flat on said blade which is adjacent the handle of the scissors.

An additional embodiment of the invention, for mounting to the top cutting blade of a scissors to move therewith in the operation thereof includes an oblong block-like element including a through bore the length thereof adjacent and spaced from one surface thereof forming its base in an application thereof to the top cutting blade of a scissors, said element having a slit directed inwardly of another exterior surface portion thereof, the slit being coextensive in length with said through bore and the exterior surface portions of said element which immediately bound said slit defining a grip portion of said element. In one perspective of such an embodiment the grip of said block-like element exhibits, in cross section, exterior surface portions which extend the length thereof and converge to a peak which presents itself at a location remote from said base. The slit in a preferred format intersects said through bore and the the plane of said slit is perpendicular to the plane of said base which is formed for a secure self-stabilized mount of said block-like element to the scissors to which it applies.

The invention further provides apparatus especially advantageous for use by mechanics, tailors, seamstresses, designers and creators of garments and other articles who must variously pattern, cut, trim, adjust and alter that on which they work as circumstances may require the basic element of which is a scissors the top cutting blade of which is distinguished by an exterior flat seated to which, intermediate the ends of its length is a holder for a slide gage rule which may be selectively applied in use of the scissors to adjust and/or alter or to variously otherwise cut, trim and segment the articles and materials to which the scissors is applied. The holder in this preferred assembly embodiment of the invention comprises a multi-surfaced element including a base surface portion embodying means to effect a self stablizing attachment of said holder to said flat to establish it in an outwardly projected relation to said blade. The holder is further distinguished by a slit directed inwardly of another surface portion of said element, said slit defining in said element a grip means accommodating the slip or snap fit insertion therein of a slide gage rule to mount this rule so as to project laterally outward from and perpendicular to said element and the blade to which it seats.

OBJECTS OF THE INVENTION

A primary object of the present invention is to provide a simplistic, relatively fast and economical system for trimming and cutting sheet material and various garments and other articles made of fabric without need for tedious preliminary marking thereof.

Another object is to provide a system of this nature featuring structure enabling in the application thereof to sheet material a simple and fast trimming and cutting therefrom of substantially uniformly idnetical strips thereof whether the lines on which they may be cut are linear or non-linear in character.

A further object is to provide improved means by the use of which one might effect rapid alteration, trimming and repair of garments and household articles of essentially sheet-like material without the need of expending any significant amount of time or effort.

An additional object is to provide a new and improved holder for mounting a rule embodying a slide gage to the top cutting blade of scissors or the equivalent thereof to thereby lend the user of the scissors or such other cutting device to which it may mount an ability to evenly trim and cut strips and segments from clothing or sheet-like materials so effectively as to obviate need for tedious premeasuring or premarking procedures while insuring quality results in a minimum period of time.

A further object is to provide such a holder the body of which is generally block shaped and has a through bore intersected by a slit defining thereby a grip securely lodging a portion of a rule which forms an extension thereof.

An additional object is to provide such apparatus, assemblies, systems and means and mode of use thereof possessing the advantageous features and inherent meritorious characteristics as are herein described and obvious therefrom. With the above and other incidental objects in view as will more fully appear in the specification, the invention intended to be protected by Letters Patent consists of the features of construction, the parts and combinations thereof, and the mode of operation as herein described and illustrated in the accompanying drawings or their equivalents.

Referring to the drawings wherein are shown some but the not the only forms of embodiment and poractictice of this invention, FIG. 1 is a perspective view of a holder for a slide gage rule or its equivalent in accordance with one preferred embodiment of the present invention;

Figure 1:
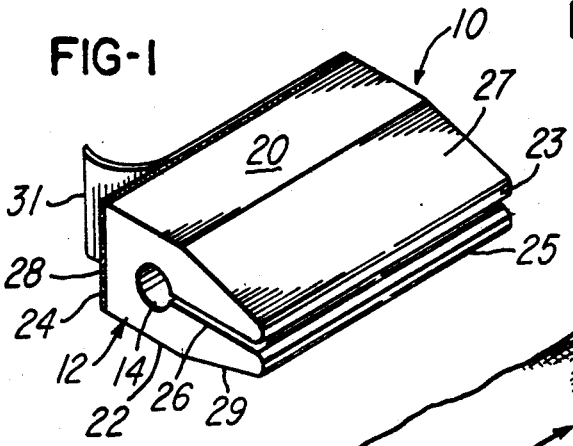
Figure 2:
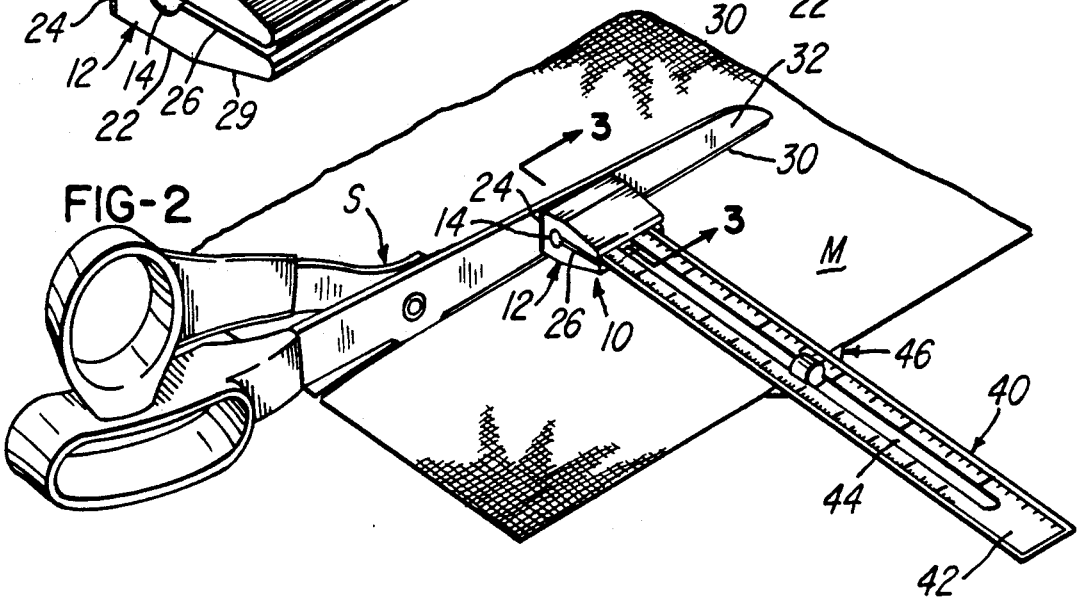
FIG. 2 is a further perspective view of the holder of FIG. 1 shown as secured to the top cutting blade of a scissor and mounting a slide gage rule in the course of its use.
Figure 5:
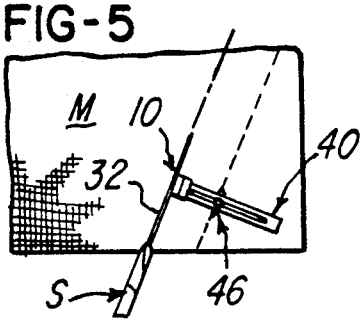
Figure 6:
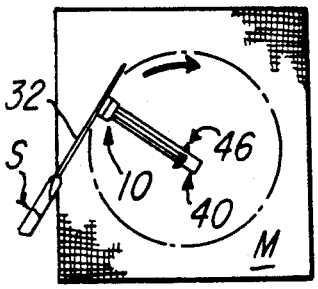
Figure 7:
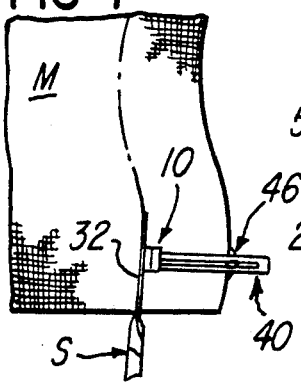
Figure 8:
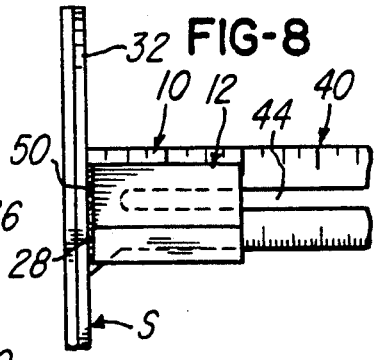

FIGS. 5, 6 and 7 respectively illustrate a utilization of the apparatus of FIG. 2 to cut the sheet material M on a bias, in a uniform circular pattern to cut disc-shaped segments thereof for design or decorative purposes and in strips having an undulating pattern the length thereof; and FIG. 8 illustrates a further mode of use of the holder of FIG. 1.

Like parts are indicated by like numerals throughout the several views.

As will be readily seen from the illustrative example of embodiments of the present invention shown in the drawings, they are most simplistic in their contrivance and versatile in their application. Moreover, they clearly demonstrate apparatus especially advantageous for use by mechanics, tailors, seamstresses, designers and creators of garments and other articles who must variously pattern, cut, trim, adjust and alter that on which they work as circumstances may require.

Figure 3:
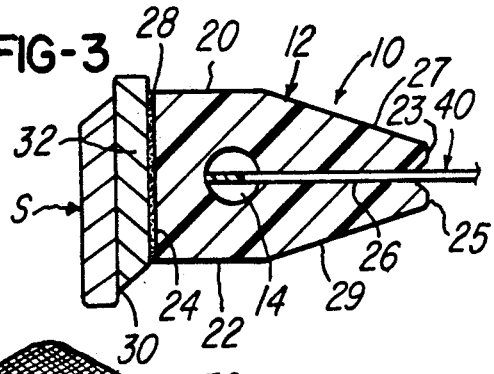
FIG. 3 is a sectional view taken on line 3—3 of FIG. 2.

More particularly, FIGS. 1–3 features an element 10, preferably fabricated of plastic material, which in accordance with one aspect of the present invention and its application provides a new and improved holder adapted to most effectively mount a slide gage sewing rule 40 or the equivalent in connection with a scissors S.

In this instance, element 10 is a small, unitary, integral structure having a short, oblong, contoured, generally block-like configuration the exterior of which presents many faces by reason of the diversity of its surface portions. These surface portions include one which defines thereon a short, oblong, rectangular base 28 which provides it with an oblong planar seating surface laterally bounded, the length thereof, by exterior side surface portions 20,27 and 22,29. Surface portions 20 and 22 are perpendicular to, correspondingly parallel and coextensive in length with the base 28. Side surface portions 27 and 29 which, respectively, are direct continuations of the surface portions 20 and 22 symmetrically converge as they project therefrom and eventually terminate in a laterally spaced co-planar relation.

In cross section, as may be clearly seen in FIG. 3, as thus provided the portion of the holder element 10 bounded by the base surface 28 and exterior side surfaces 20 and 22 is, in the attitude shown in the drawings, a rectangular base portion of the body of element 10 distinguished by a through bore 14 and surmounted by an integrated portion 12 of said body having, in cross section the configuration of a substantially symmetrical truncated triangle. Note that the surface produced in the production of a truncation of the peak of this triangle is intersected midpoint thereof by slit 26 coextensive in length with and extending inwardly of and in bisecting relation to the element 10 in a plane perpendicular to the base surface 24 and in a parallel equidistantly spaced relation to surfaces 20 and 22. So provided, slit 26 intersects and opens to the length of the throughbore 14 at its innermost end.

As will be further obvious, slit 26 divides the triangular portion of the holder element 10, from a point shortly beyond said base surface 28 to that point where the slit 26 opens outwardly from the truncated peak thereof, into two finger-like portions 23 and 25 thereof. This bisection and the material employed in the forming of the element 10 is such to endow the fingers 23 and 25 with a biased relation of one to the other and a capability of a limited outward flexing thereof. The lateral dimension of the slit 26, which is slightly expanded at the opening thereto, and the degree of flexing capability of said fingers, is made such to accommodate the tight insertion therein and therebetween of the base end of any one of a limited range such slide gage rules or other rule as one may desire to use in connection with the holder for a particular application of the apparatus to which it mounts. Thus, on thrusting the desired rule inwardly of said slit by way of the expanded mouth thereof at its outer end and by reason of the predetermined relative dimensioning of the parts, fingers 23 and 25 define a grip portion of the element 10 affording a secure retention of the applied rule for as long as desired.

As will be obvious those surfaces defining the ends of the length of holder element 10 are in this instance parallel and correspond in shape, size and configuration to the above described uniform cross section of element 10 within the length thereof.

Another feature of the illustrated holder element 10 is that that surface thereof which is to define its base will be coated with a layer of high strength adherent adhesive 28 which endows it with the characteristic and porperty to achieve a self stabilized secure mount thereof to an exterior surface portion of that cutting blade to which it must apply in use. During such time as is prior to such mount of the element 10 merely by seating its base to a cutting blade, the outer surface of the layer of adhesive 28 is protected by a strip 31 of a suitable film which must be peeled off to enable the described mount of the element 10 to take place.

FIGS. 2 and 3 demonstrate a use and application of the holder element 10 in combination with a sewing rule 40 embodying a slide gage 46 in connection therewith and the mount thereof to a portion of the length of an exterior flat 32 of a top blade of a scissors S applied to the cutting and trimming of sheet material in the nature of a fabric. In the example illustrated the scissors is applied to the precision cutting from this sheet material, commencing from a border thereof, of a strip or strips of material having a uniform prescribed width and configuration. Note that in the mount and use of the holder element 10 in this instance the holder and the rule project laterally outward from the cutting blade immediately of its cutting edge and intermediate of the length thereof and the gage 46 is set to the precise width required of the length of strip material being cut, taking into consideration the short distance between base surface 24 of the holder and the most adjacent point of the peripheral edge of throughbore 14 which is in line with slit 26. For the convenience of the user of the scissor assembly according to the present invention this short distance to be taken unto consideration is either noted on or in connection with the holder element per se or means provided in connection therewith.

Figure 4:
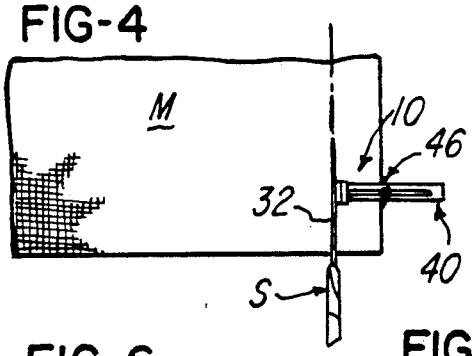
FIG. 4 is a reduced top view of that which is shown in FIG. 2.

Thus, given the foregoing, prior to cutting the first strip from the sheet material M, considering the orientation thereof shown in FIG. 2, all a user of the assembly including the scissors S need do to insure an ability to quickly cut the sheet of material M into a number of virtually identical strips thereof is to first establish the set gage 46 of the rule with reference to the holder element, as described, to the width of the strip desired and then set the gage against the right edge of the sheet material (or edge of a garment from which a strip of material must be removed for the shortening thereof) immediately of that edge of the sheet of material at which cutting is to be commenced. This being accomplished the cutting edge of blade is automatically set at a point of reference where the cut of the material must be initiated, following which, guided by the slide gage and the right edge of the material the user of the scissors is enabled to quickly and easily achieve the removal from the sheet of material M a strip thereof having that size and configuration of the strip prescribed. At the same time a new right edge of the sheet is defined which parallels the first reference edge and defines the reference edge of the second strip to be cut in similar manner. As will be obvious, each succeeding cut will be parallel to the first, against which the slide gage moved in cutting the first strip. FIG. 4 clearly demonstrates the line of cut and ease with which one can achieve the cutting of each virtually identical strip.

As will be seen no extensive or tedious or time consuming premarking of the material. All that one has to do as a preliminary establish a point of reference for the cutting.

FIG. 7 points out and emphasizes the fact that the apparatus of the invention can be similarly easily applied with full effectiveness to cut strips which are nonlinear as well as linear in character.

By the same token the preceding makes it equally obvious that the use of the described apparatus on its equivalent is especially advantageous for use by tailors, seamstresses, designers and creators of garments and other articles who must variously pattern, cut, trim, adjust and alter that on which they work, whether the cut is required to be in straight lines or otherwise.

FIG. 8 exhibits a variation of the embodiment of FIGS. 1-3 wherein the holder element 10 is turned on end and one of its end surfaces, here designated as 50, is used as its base, in which event the exterior surface of such base end 50, excluding the areas of the throughbore 14 and slit 26 which open therefrom, is provided with a layered coating of the adhesive 28 which in this case is also protected, prior to use, by a strip of film material 31, in the same manner as the adhesive coating on the exterior surface 24 of the first described embodiment of the invention. When seating the base end 50 of the holder element 10 to the flat exterior surface 32 of the top cutting blade of a scissors such as the scissors S shown in FIG. 2, rule 40 will be inserted in the slit 26 to have a portion of its length immediately of its base within the grip, to the extent of the slit 26, and its base end adherently abutted to the flat 32 of the scissors blade. In this case the length of rule 40 is firmly and most stably backed by the holder and the user will not have to consider any adjustment of the slide gage 46 in the initial setting thereof. Otherwise, the assembly of FIG. 8 is inclusive of the same detail and means and mode of application as seen in FIGS. 2, 4 and 7.

Extensive testing has proven that apparatus constructed and applied as herein illustrated, described and/or claimed does in fact accomplish all the objects and present all the advantages in use which have hereinbefore been set forth. Even more, such testing has explicitly and repeatedly lent assurance that what is herein claimed as to the features of the various embodiments of the holder element of the invention will in the use thereof not only improve the speed of the output of users thereof but also the quality of their workmanship. Such testing has also confirmed that the subject holder elements per se and in their various assemblies lend significant benefits in the use thereof by mechanics, tailors, seamstresses, designers and creators of garments and other articles who must variously pattern, cut, trim, adjust and alter that on which they work.

For that matter it must be pointed that in use of holder elements of the invention in assemblies such as illustrated one, as pointed out previously, needs only to establish a single point of reference in a decorative disc-shaped segment of fabric of a sheet presenting numerous thereof, set the radius required to bound said segment on the sewing rule assembled to a holder element per the invention as herein prescribed, which holder is secured to a cutting blade and then one can swiftly and repeatedly use the established point of reference to produce a circular cut thereabout and extract segment after segment from the sheet for their use as decorative applications to other articles.

This is clearly demonstrated in FIG. 6 of the drawings.

FIG. 5 demonstrates that one can also use embodiments of the invention when strips or segments are to be cut from cloth or other sheet-like materials or from garments only a bias. In that case on a single line need be drawn on a bias as a point of reference and one can proceed thereafter, to the extent strips or segments need be cut as one does as demonstrated with reference to the operations of FIGS. 4 and 7.

Most importantly, all that has been set forth above confirms that the use of holder apparatus per the present invention in assembly lends the user of the cutting blade to which it mounts an ability to evenly trim and cut strips and segments from clothing or sheet-like materials so effectively as to obviate need for tedious premeasuring or premarking procedures while insuring quality results in a minimum period of time.

From the above description it will be apparent that there is thus provided a device and assemblies of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

Having thus described my invention, I claim:

1. Apparatus especially advantageous for use by mechanics, tailors, seamstresses, as well as designers and creators of garments and other articles, who must variously pattern, cut, trim, adjust and alter that on which they work, as circumstances may require, comprising a holder designed to mount to a cutting blade which may be selectively applied to adjust and/or alter or to variously otherwise cut, trim and segment the articles and materials to which it applies, said holder being a multi-surfaced element including a base surface portion per se having means for the stable mount thereof to a cutting blade to establish it in an outwardly projected relation thereto, a slit directed inwardly of another surface portion of said element, said slit defining in said element, as an integral part thereof, a grip means accommodating the insertion therein of a slide gage rule to mount this rule so as to project outwardly from and perpendicular to said element and the blade to which it seats.

2. Apparatus especially advantageous for use by mechanics, tailors, seamstresses, as well as designers and creators of garments and other articles, who must variously pattern, cut, trim, adjust and alter that on which they work, as circumstances may require, applicable to a flat on the top cutting blade of a scissors, comprising a multi-surfaced element constituting a body for mounting a slide gage rule in an outwardly directed laterally projected relation to the cutting blade to which it is applied, said body including a slit directed inwardly of the body thereof, said body having a bore therein intersected by the innermost limit of the slit and said slit being oriented perpendicular to one surface portion of said body which defines its base.

3. Apparatus as in claim 2 wherein said base surface includes means to effect an adherent mount thereof to that surface of the cutting blade to which it applies.

4. Apparatus as in claim 2 wherein said multi-surfaced element has an oblong configuration and said bore and said slit are coextensive in length and extend the length of said body.

5. Apparatus especially advantageous for use by mechanics, tailors, seamstresses, as well as designers and creators of garments and other articles, who must variously pattern, cut, trim, adjust and alter that on which they work, as circumstances may require, comprising a holder for a slide gage rule having a substantially block shaped form, one surface of which defines its bottom which is adapted to seat to a flat portion of the exterior surface portion of the top cutting blade of a scissors, a slit directed inwardly of and opening outwardly from another surface portion of this substantially block-shaped form in a plane which is perpendicular to said bottom and bounded by means shaped to accommodate the insertion and retention in said slit of a portion of a slide gage rule to inherently establish such a rule in an outwardly projected relation to said holder and essentially perpendicular to the blade surface to which it seats.

6. Apparatus especially advantageous for use by mechanics, tailors, seamstresses, as well as designers and creators of garments and other articles, who must variously pattern, cut, trim, adjust and alter that on which they work, as circumstances may require, including means mounting to a flat of the top blade of a scissors or like cutting device within its limits to form an assembly therewith in use, said means comprises a holder having a generally oblong substantially block-like configuration one surface portion of which provides its bottom and correspondingly its base which seats to the aforementioned flat, said base being provided with means to cause it to adhere to said flat, said holder having a second surface portion thereof distinguished by an inwardly directed slit which accommodates and defines a grip portion of the holder formed to receive, accommodate and retain a portion of a slide gage rule or its equivalent and establish it in a perpendicularly projected relation to that flat to which the holder seats.

7. Apparatus as in claim 6 wherein an exterior surface portion of the holder at one end of the length of said oblong block-like configuration defines said bottom portion thereof which seats to said flat in a construction and arrangement which sets both the length of said holder and said rule in an established laterally projected relation to said scissors in use thereof and lends the user an ability to evenly trim and cut strips and segments from clothing, garments and other articles of fabric or sheet-like materials so effectively as to obviate need for tedious premeasuring or premarking procedures while insuring quality results in a minimum period of time.

8. Apparatus especially advantageous for use by mechanics, tailors, seamstresses, as well as designers and creators of garments and other articles, who must variously pattern, cut, trim, adjust and alter that on which they work, as circumstances may require, comprising a device adapted to be secured to a cutting device including an oblong block-like element having a slit directed inwardly of one surface thereof in intersecting relation to a bore directed inwardly of said block from another surface thereof which is in an adjacent spaced relation to a third surface thereof defining the base of said block, said slit being bounded by means formed to inherently accommodate and grip a portion of a slide gage rule which is applied therein to establish such rule in an essentially perpendicular relation to said base.

9. Apparatus as in claim 8 including a scissors what constitutes a top cutting blade of which in use has a flat exterior surface portion extending longitudinally thereof to that extremity thereof adjacent its cutting extremity, said base of said oblong element being secured to said flat exterior surface portion of said blade intermediate the length thereof and said slit having a slide gage rule lodged therein to project outwardly therefrom and in an orientation perpendicular to the base of said block and laterally of said scissors blade in the course of the application of said scissors to its intended use.

10. Apparatus as in claim 9 wherein said oblong element has the length thereof oriented lengthwise of said blade at a location more closely adjacent said cutting extremity of said blade than that end of the flat exterior surface portion of said blade which is remote therefrom.

11. Apparatus especially advantageous for use by mechanics, tailors, seamstresses, as well as designers and creators of garments and other articles, who must variously pattern, cut, trim, adjust and alter that on which they work, as circumstances may require, comprising an oblong block-like element including a through bore the length thereof adjacent and spaced from one surface thereof forming its base in an application thereof to the top cutting blade of a scissors relatively adjacent that end thereof constituting its projected extremity in use, said element having a slit directed inwardly of another exterior surface portion thereof, the slit being coextensive in length with said through bore and the exterior surface portions of said element which immediately bound said slit defining a grip portion of said element.

12. Apparatus as in claim 11, wherein said grip portion exhibits, in cross section, exterior surface portions which extend the length of said oblong block-like element and converge to a peak which presents itself at a location remote from said base.

13. Apparatus as in claim 12, wherein the plane of said slit is perpendicular to the plane of said base which is formed for a secure self-stabilized mount of said block-like element to the scissors to which it applies.

14. Apparatus especially advantageous for use by mechanics, tailors, seamstresses, designers and creators of garments and other articles who must variously pattern, cut, trim, adjust and alter that on which they work as circumstances may require including scissors the top cutting blade of which is distinguished by an exterior flat seated to which, intermediate the ends of its length is a holder for a slide gage rule, said holder comprising a multi-surfaced element including a base surface portion embodying means to effect a self stabilizing attachment thereof to said flat to establish it in an outwardly projected relation to said blade, said holder being further distinguished by a slit directed inwardly of another surface portion of said element, said slit defining in said element a grip means formed to accommodate the slip or snap fit insertion therein of a slide gage rule to mount this rule so as to project outward from and perpendicular to said element and laterally of the blade to which it seats.

* * * * *